United States Patent [19]

Andersson

[11] Patent Number: 4,830,275

[45] Date of Patent: May 16, 1989

[54] TEMPERATURE CONTROL OF BUILDINGS

[75] Inventor: Lars-Olof Andersson, Saltsjöbaden, Sweden

[73] Assignee: Rli Byggdata AB, Saltsjobaden, Sweden

[21] Appl. No.: 213,282

[22] Filed: Jun. 29, 1988

[30] Foreign Application Priority Data

Aug. 22, 1987 [GB] United Kingdom ..... 8719867

[51] Int. Cl.[4] ..... F24F 7/06

[52] U.S. Cl. ..... 236/49.1; 98/31; 165/56; 165/57; 237/69

[58] Field of Search ..... 165/35, 103, 53, 56, 165/57; 236/49 R; 98/31; 237/43, 69

[56] References Cited

U.S. PATENT DOCUMENTS

| | | | |
|---|---|---|---|
| 1,986,893 | 1/1935 | Hasbrouck et al. | 165/35 |
| 2,392,240 | 1/1946 | Frankel | 165/56 |
| 2,559,871 | 7/1951 | Gay | 237/69 X |
| 2,917,240 | 12/1959 | Schwarzmayr | 237/69 |
| 3,166,121 | 1/1965 | Boysen et al. | 165/35 |
| 3,516,347 | 6/1970 | May | 98/31 |
| 4,069,973 | 1/1978 | Edwards | 165/56 X |
| 4,103,578 | 8/1978 | Cooper | 165/53 X |
| 4,135,440 | 1/1979 | Schmidt et al. | 98/31 |
| 4,646,966 | 3/1987 | Nussbaum | 98/31 X |
| 4,775,001 | 10/1988 | Ward et al. | 165/57 X |

*Primary Examiner*—William E. Tapoicai
*Attorney, Agent, or Firm*—Holman & Stern

[57] ABSTRACT

This is a system for the air conditioning of rooms in building, which rooms are defined by concrete floor structures with hollow ducts connected in series in parallel with each other and in groups, in order to bring about effective heat exchange between concrete and supply air flowing through each duct group before being fed to the room via a supply air device. The supply air to each duct group is taken via a pipe connection from a main duct for supply air and is evacuated from the room in another way. In order to control the heat absorbtion (heat inertia) of the duct group according to the actual demand for each room so that the air-flows in each of the two connections of the duct group are balanced corresponding to the actual cold/heat demand. Each or some certain duct groups in the room includes a branching device (16) which is located between the main duct (5), or a branch thereof, and a second connecting place (11) to the duct group. Hereby the duct length from said connection (11) to said supply air device (12) to the room is shortened substantially relative to the duct length of the entire duct group.

4 Claims, 4 Drawing Sheets

TEMPERATURE CONTROL OF BUILDINGS

STATE OF THE ART

Modern buildings, for example offices, due to their good insulation and airtightness, have become very sensitive as regards temperature to internal heat development, primarily form lighting, staff, computers and other machine equipment.

In order to maintain the room temperature within an acceptable range, the surplus heat must be removed more or less instantaneously. At present a number of different methods are applied, for example cooling ceilings, fan coils, miniair systems with low air flows and high pressure drops over ejection nozzles for simultaneous ejection of room air via cooling convectors with cooled water, direct cooling with cooled supply air, cooled floor structures, etc. From the aforesaid methods especially two main principles can be noticed: small air flows with addition of waterborne cold and large cooled variable air flows. In the case of the lastmentioned one, the temperature of the air supplied must not be lower than 16°–17° C., in order to prevent draught. The said temperature criteria as well as restricted possibilities of feeding large flows of supply air determine an upper limit for the control of the internal heat development.

The method according to the present invention follows a different path. According to this method, both the floor structure of a building with high thermal capacity and small air flows of low temperature, $<15°$ C., are utilized, but without giving rise to draught.

The invention comprises floor structures, which in known manner consist of pre-fabricated hollow concrete slabs or concrete floor structures with cast-in ducts. Cooled supply air flows through the floor structure before it is supplied via a supply air device to the room unit in question. On its passage through the floor structure the cooled air has taken up heat from the floor structure, and at its passage through the supply air device it has assumed a temperature well in agreement with the mean temperature of the floor structure, i.e. a temperature, which is lower than the room air temperature by one or some degrees. The floor and ceiling surfaces, thus, constitute large cooling surfaces, which provide thermal stability to the room, at the same time as the supply air is fed to the room with a temperature, which does not give rise to draught.

Due to the fact, that a small supply air flow with low temperature, lower than normal according to the second alternative above, flows through the floor structure more or less continually, a reservoir is obtained which takes up the surplus heat developed mostly during daytime. The temperature control described above manages the handling of fixed recurring internal loads. In the case of momentary peak loads, for example solar leak-in, great number of persons, etc., the cooling surfaces (floor and ceilings) are not capable to take up the surplus heat, but the temperature of the room air increases, whereby the comfort criteria can be exceeded. One possible way of removing those parts of the peak load which are not taken up in the floor structure, is to momentarily direct the low-tempered supply air past the floor structure and directly into the room. This method, however, is not recommendable, because it immediately comes into conflict with the aforesaid draught criteria.

The invention instead makes use of the possibility of directing the greater part of the low-tempered supply air flow via a shunt-line past the greater part of the floor structure and thereafter possibly mix it with the remaining air flow, which at its passage through the floor structure has assumed the mean temperature of the floor structure, in order in this way to feed to the room a supply air with a temperature not giving rise to draught problems.

The invention becomes more apparent from the following description, with reference to some embodiments thereof based on the associated drawings.

Figure 1:
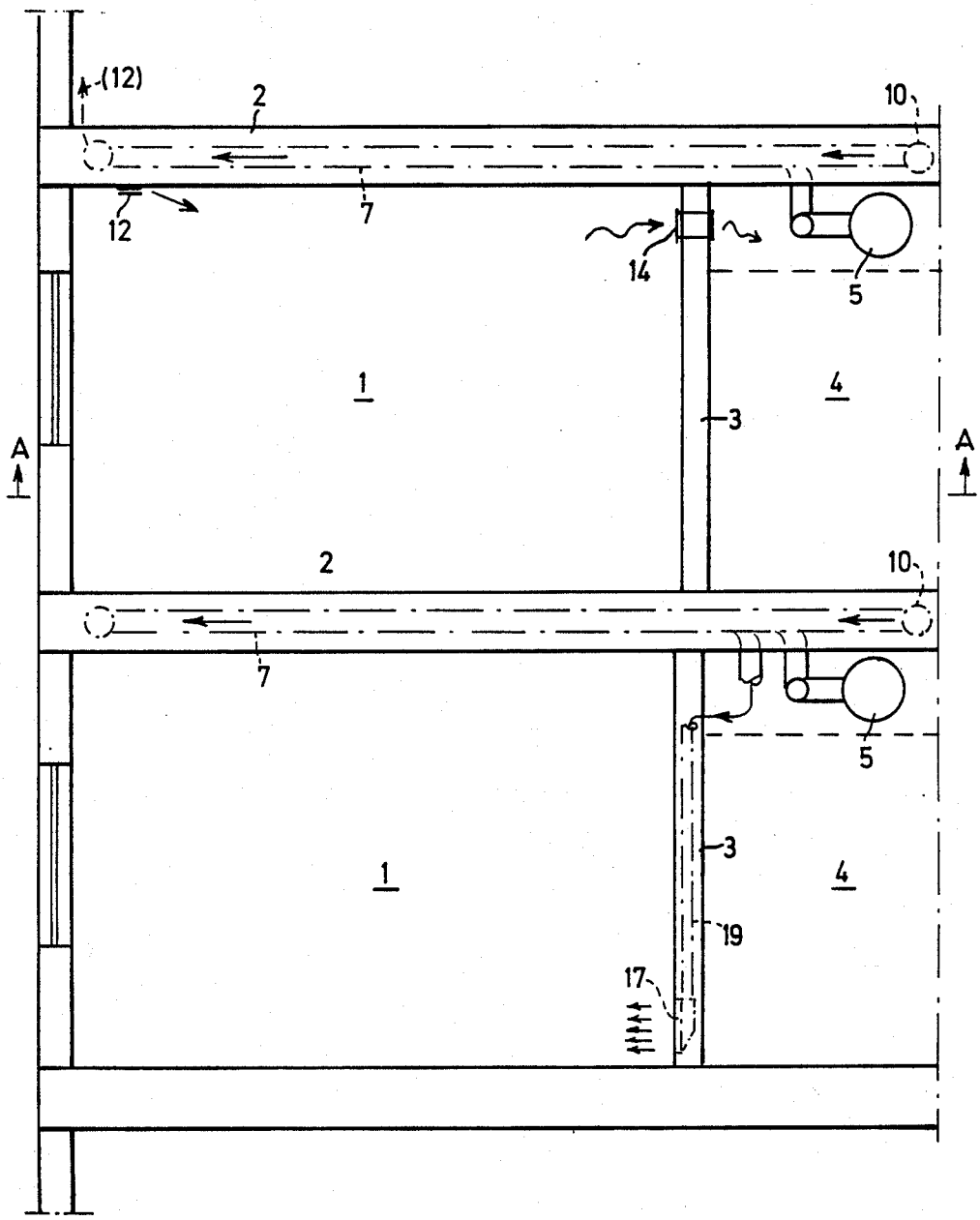
FIG. 1 shows schematically a building with two rooms located one above the other and ducts for air conditioning the rooms.

According to the vertical section in FIG. 1, the building comprises a number of rooms, two of which are shown in the drawing. Outside each room a corridor 4 is located, in the false ceiling of which a supply air duct 5 is connected to a hollow duct 7 located in the floor structure 2. The rooms 1 are defined toward the corridor 4 by a partition wall 3 and relative to each other in horizontal direction by partition walls 13.

Figure 2:
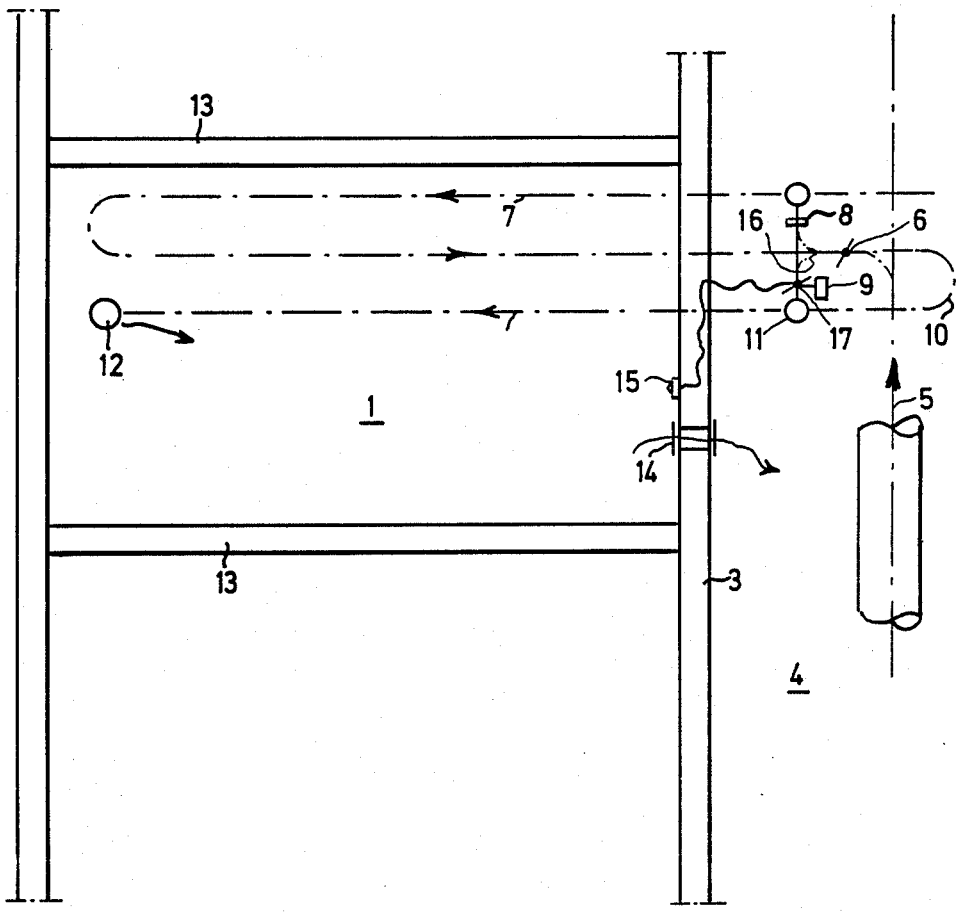
FIG. 2 is a section along the line A—A in FIG. 1 and shows the duct system designed according to the invention.

According to FIG. 2, the supply air is fed from the duct 5 via throttling damper 6, throttle valve 8, duct 7, bend 10 and device 12 into rooms 1. The supply air, which in duct 5 has a temperature below 15° C., after having passed the floor structure via duct 7 has assumed the temperature of the floor structure of about 21°–23° C. The temperature of the room air is some degree higher than the temperature of the floor structure. When the temperature of the room air increases above a desired value set on the temperature gauge 15, the damper motor 9 opens, and the greater part of the supply air due to the lower pressure takes the way via a branching 16 with damper 17 to a connection on the duct 18. The remaining part of the supply air, due to the pressure drop in the throttle valve 8, takes the way via the bend 10 before it arrives at the connection 11 where it, after possible admixture and after having passed through the distance 11/12, arrives at the device 12 with a selected temperature, which does not cause draught sensation, for example higher than +16° C. The supply air in duct 5 can, for example, be in the temperature range +8° to +15° C. After having passed through room 1, the air flows out via overflow device 14 into the corridor space and then via a return air system is recirculated in conventional manner to the fan room. When the tempered air is supplied to the room, the heat emission in the room substantially is removed partially via the heat absorption in the supply air and partially via the heat adsorption in the floor structure (ceiling and floor) enclosing the room. When the room temperature has dropped to a temperature corresponding to the set desired value, the damper motor 9 closes and the entire supply air flow passes the floor structure via the path 8,7,10,12.

Figure 3:
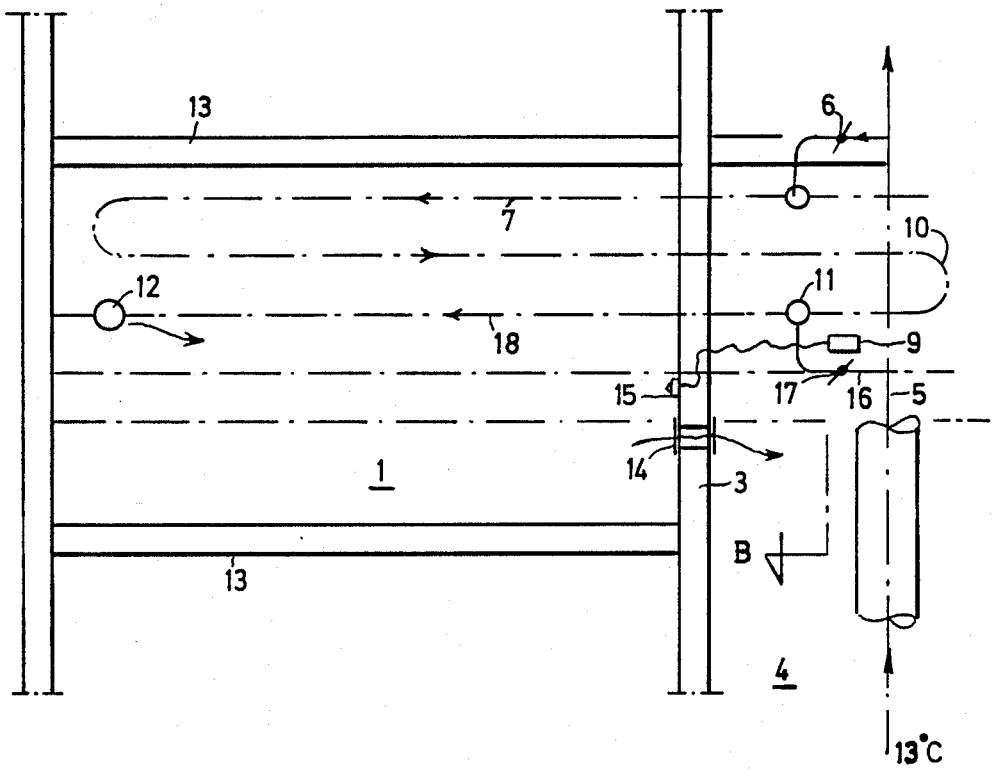
FIG. 3 shows the same as FIG. 2, but in a variant of the invention.
Figure 4:
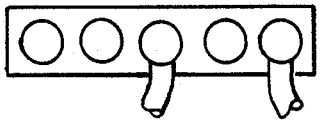
FIG. 4 is the section B of FIG. 3.

FIG. 3 shows a connecting method alternative to the one shown in FIG. 2.

By positioning an additional gauge in duct 11/12 or supply air device 12, the desired supply air temperature can be adjusted via the damper motor 9 to avoid draught problems.

From the connecting point 11 the supply air via duct 19 (FIG. 1) also can be fed via supply air devices 17 located at the floor. When room 1 is located on the facade facing south, and a common fan unit supplies rooms both on the north and south, the rooms having momentarily a high internal load, preferably rooms facing south, after adjustment of the throttling damper 6 and possibly 8, upon opening of the damper motor 9 can receive a greater air flow for removing peak loads. The momentarily greater amount of surplus air is taken from the rooms, due to lower pressure difference, preferably on the facade facing north, which have not such an internal surplus heat, that direct cold via the path 9,11,12 is required.

When all cooled supply air in the manner used heretofore continuously passes the floor structure, about 75% of the energy supplied to the room is taken up by the floor structures, about 15% is removed with the exhaust air, and the remaining 10% is removed via leakage air and windows (Alt. I).

At the invention, the proportions are about 45%, 45% and 10%, i.e. compared with previously more removed energy has been transferred from the floor structures to the ventilation air, resulting in a lower room temperature. At the known method, a great part of the energy developed during daytime is stored in the floor structures and is removed during non-working hours, which causes a room temperature about 2° C. higher than according to the invention. Due to the greater air flow (momentarily), the cooling effect increases by about 40% (Alt. II).

In an alternative case, the room is provided with false ceiling and an installed cooling effect, which maintains a constant room temperature of 22° C. Very little is stored here in walls and floor structure, because in the masses of the building no temperature variation takes place, the entire cooling effect is developed during working-hours (i.e. 08–17 o'clock) and the losses via windows and leakage are small as in Alt. 1, i.e. 10% (Alt. III).

The added cooling effect, thus, corresponds here to 90% of the internal effect developed during daytime. This is to-day the method mostly used at the dimensioning of cooling installations. When comparing this method with the invention, where there is the same mean room temperature during working-hours, a great difference in installed cooling effect is obtained, due to the spread of cooling effect over 24 hours, according to the invention, compared with an effect developed during nine hours, according to the conventional method. The simultaneity effects for the entire building are assumed equal in both alternatives. Assuming the emitted energy during nine hours=E:

In the way stated above a building can be dimensioned to manage large momentary surplus heat by utilizing a small air flow with a very low temperature. The air flow can be restricted in that it more or less continuously cools down the floor structures, and when required instantaneously is permitted to increase over the room units concerned in temperature and flow, but without exceeding the draught criteria.

At the embodiment shown in FIG. 2, the connection 11 is made at the last duct in a group of ducts. It is hereby possible, with the help of the adjustability of damper 9, to achieve the necessary increase and, respectively, decrease in the temperature of the directly fed supply air, without the temperature level of the air flowing out of the device 12 giving rise to inconvenience, but yet achieving the desired air conditioning of the room in its entirety. It can prove possible that a good effect also is obtained when connection is made to the next to last duct.

Figure 5:
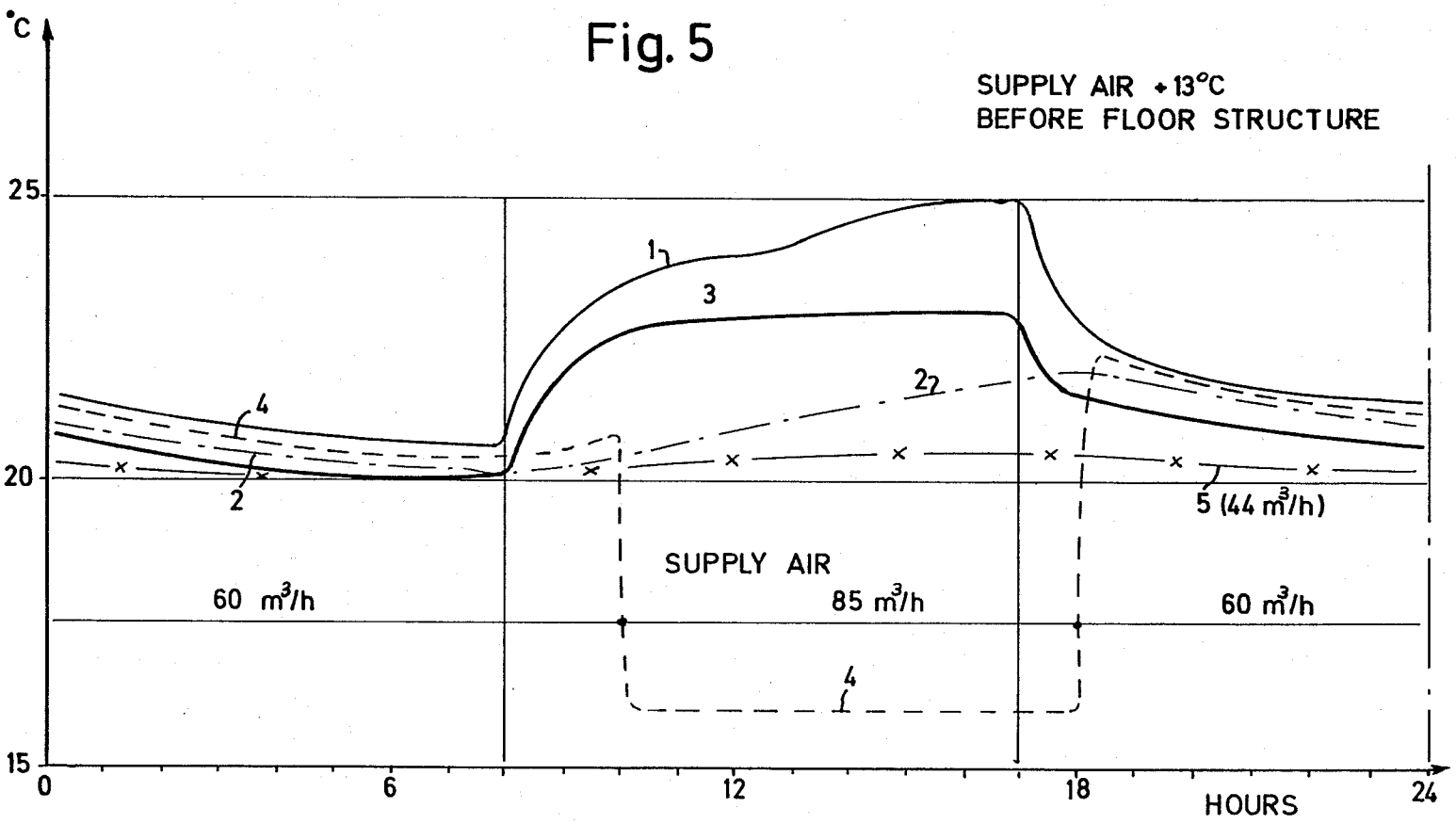
FIG. 5 is a temperature-time diagram.

In the diagram according to FIG. 5 the variation in temperature in room 1 during a 24-hour period is illustrated. The room is assumed at the calculations to have a surface of 10 $m^2$, the outer wall faces south, the window is a three-glass window with a glass surface of 1.5 $m^2$ and a Venetian blind in the central glass, the internal load consisting of lighting and terminal corresponding to an effect of 300W between 8.00 o'clock and 17.00 o'clock. The outside temperature is 19° C.±6° C. One person stays in the room from 08.00 o'clock to 12.00 o'clock and from 13.00 o'clock to 17.00 o'clock. The temperature of the supply air before the floor structure is assumed to be 13° C. Curve 1 indicates the temperature variation in the room when the entire air flow of 60 $m^3/h$ passes the floor structure before it flows out into the room. The maximum temperature of the room is reached at about 16.00 o'clock. Curve 2 indicates the temperature of the supply air in the supply air device after the floor structure. Curve 4 indicates the supply air temperature +16° C. in the supply air device, after admixture of about 20 $m^3/h$ supply air having passed the floor structure has taken place. The remaining part 65 $m^3/h$ has been supplied directly via path 11/12 according to FIG. 2. The computer calculations show, that due to the invention the room temperature could be lowered instantaneously by about 2° C. without a greater cooling effect and a higher fan capacity having to be installed. See the difference between curves 1 and 3. Curve 3 indicates the temperature variations in the room at the air flow 60 $m^3/h$ between 18.00 o'clock and 10.00 o'clock, and a flow of 85 $m^3/h$ between 10.00 o'clock and 18.00 o'clock. The maximum room temperature here is about +23° C.

The rooms in the example are oriented substantially toward north and south. When 40% of the rooms, i.e. the greater part of the rooms facing south at 10.00 o'clock exceed 22.5° C., the throttle valves open and the flow increases from 60 $m^3/h$ to 85 $m^3/h$, corresponding to an increase of about 40%. The remaining rooms then receive a smaller flow, i.e. (1–1.4±0.4). 100=73%. The flow, thus, decreases in these rooms from 60 $m^3/h$ to 0.73±60=44 $m^3/h$. When some of the rooms facing north are not loaded, the room temperature there follows curve 5, which during the entire 24 hours is immediately above +20° C. At a full air flow the corresponding temperature curve would be at about +19° C. with resulting negative climate sensation.

The above shows how the effect of the invention can be utilized at the control of the temperature in a building with different load preconditions at a minimum of installed cooling effect.

I claim:

1. An air conditioning system for a room in a building having a concrete floor structure with duct means formed in the floor structure for supply air to flow through before being discharged into the room, the system further including an air supply means for supplying air to the duct means, an air supply device for delivering air from the duct means into the room, the duct means defining a first flow path for air to flow between the supply means and the supply device, and a branch duct connected between the supply means and the duct means by-passing at least a part of the duct means and providing a second flow path for air to flow between the supply means and the supply device, the second flow path being shorter than the first flow path whereby air flow into the room through the supply device can be controlled proportionally as between the respective flow paths to adjust the cooling effect of the system.

2. A system as defined in claim 1 including a flow adjustment damper in the branch duct and control means for providing adjustment of the damper responsive to conditions in the room.

3. A system as defined in claim 2 wherein the control means includes a temperature gauge.

4. A system as defined in claim 2 wherein the control means include manual means for adjusting the damper.

* * * * *